US011764532B2

(12) United States Patent
Ikeda et al.

(10) Patent No.: US 11,764,532 B2
(45) Date of Patent: Sep. 19, 2023

(54) METAL GRAPHITE GROUNDING BRUSH MAINLY COMPOSED OF SILVER AND METHOD FOR PRODUCING SAME

(71) Applicant: TRIS INC., Matsusaka (JP)

(72) Inventors: Mitsuo Ikeda, Matsusaka (JP); Hirotada Kanagawa, Matsusaka (JP); Mitsuhiro Hirota, Matsusaka (JP); Yoshihiro Nishimura, Matsusaka (JP)

(73) Assignee: TRIS INC., Matsusaka (JP)

( * ) Notice: Subject to any disclaimer, the term of this patent is extended or adjusted under 35 U.S.C. 154(b) by 0 days.

(21) Appl. No.: 17/778,143

(22) PCT Filed: Nov. 18, 2020

(86) PCT No.: PCT/JP2020/042925
§ 371 (c)(1),
(2) Date: May 19, 2022

(87) PCT Pub. No.: WO2021/106700
PCT Pub. Date: Jun. 3, 2021

(65) Prior Publication Data

US 2023/0006405 A1 Jan. 5, 2023

(30) Foreign Application Priority Data

Nov. 25, 2019 (JP) ..... 2019-212628

(51) Int. Cl.
*H01R 39/22* (2006.01)
*H01R 4/66* (2006.01)
(Continued)

(52) U.S. Cl.
CPC ..... *H01R 39/22* (2013.01); *H01R 4/66* (2013.01); *H01R 39/24* (2013.01); *H01R 43/12* (2013.01)

(58) Field of Classification Search
CPC ..... H01R 39/22; H01R 39/24; H01R 43/12; H01R 4/66
See application file for complete search history.

(56) References Cited

U.S. PATENT DOCUMENTS 3,601,645 A * 8/1971 Whiteheart ..... H01R 39/36 29/826
5,168,620 A * 12/1992 Denney ..... H01R 39/36 310/248

(Continued)

FOREIGN PATENT DOCUMENTS

JP 2007-060861 A 3/2007
JP 2016-525329 A 8/2016

*Primary Examiner* — Dang D Le
(74) *Attorney, Agent, or Firm* — KEATING AND BENNETT, LLP

(57) ABSTRACT

The metal graphite grounding brush including silver is made in slide contact with a peripheral surface of an axle and grounds the axle. The mass ratio between silver and carbonaceous components including a volatile component in the brush is silver above 30% and up to 90% and carbonaceous components less than 70% and down to 10%. When the total of silver and carbonaceous components is made 100%, the volatile component is down to 2.0% and up to 15%. The brush grounds the axle reliably so that noise from a car radio is reduced and has a long service life and mechanical strength.

8 Claims, 4 Drawing Sheets

(51) Int. Cl.
*H01R 39/24* (2006.01)
*H01R 43/12* (2006.01)

(56) References Cited

U.S. PATENT DOCUMENTS

| | | | | |
|---|---|---|---|---|
| 7,642,688 | B2 * | 1/2010 | Nakayama | H01R 39/20<br>428/408 |
| 10,903,613 | B2 * | 1/2021 | Kagawa | H01R 39/26 |
| 11,146,152 | B2 * | 10/2021 | Kawamata | C01G 25/02 |
| 2016/0134072 | A1 | 5/2016 | Faber et al. | |

* cited by examiner

METAL GRAPHITE GROUNDING BRUSH MAINLY COMPOSED OF SILVER AND METHOD FOR PRODUCING SAME

FIELD OF THE INVENTION

The present invention relates to a metal graphite grounding brush including silver as one of the main components for reducing electro-magnetic noise and a method for its production. The invention relates to a brush for grounding a driving axle, for example, of a motor-driven vehicle and, in particular, to the grounding brush for reducing electro-magnetic noise to a car radio in a vehicle.

BACKGROUND ART

The driving systems for motor vehicles have been changing from engine-driven systems to electric motor-driven systems. In particular, electric vehicles without an engine have globally been developed and accepted in the market for reducing greenhouse gases. The acceleration and deceleration of the vehicles are performed by controlling the rotation number of the electric motor by an inverter, and an onboard computer controls the inverter according to various input information.

The inverter interrupts a current to change the voltage and frequency applied to the motor. As a result, high-frequency energy is caused, leaks to the outside through the driving axle or the like of the electric vehicle, and generates electro-magnetic noise. The electro-magnetic noise affects badly controlling devices of the electric vehicle, onboard electronic devices, audio equipment such as a car radio, and, in particular, makes the sound of the car radio noisy. The same problem occurs in hybrid cars running by both an engine and an electric motor.

Related pieces of prior art will be introduced. Patent Document 1 (JP2016-525329) proposes a carbonaceous grounding brush containing silver by 1 to 8%. The grounding brush according to Patent Document 1 has, however, too high resistance for grounding an inverter of an electric vehicle.

Patent Document 2 (JP2007-60861) proposes a brush including 70 mass % silver for rotating electrical equipment. This brush is in slide contact with a commutator, polishes an oxide film on the commutator by the silver particle, and reduces the generation of commutator spark. As a result, the noise from the rotating electrical equipment is reduced. Patent Document 2, however, does not disclose to ground an inverter. Further, the mechanism for reducing noise is to reduce the commutator spark, not to ground a shaft.

PRIOR ART DOCUMENTS

Patent Document

Patent Document 1: JP2016-525329
Patent Document 2: JP2007-60861

SUMMARY OF THE INVENTION

Problems to be Solved by the Invention

The object of the invention is to provide a grounding brush that has strength and service life compatible with usual brushes for rotating electric equipment and is capable of discharging efficiently the electro-magnetic noise from a driving axle of a vehicle driven by an electric motor.

The object of the invention is, for example, to reduce efficiently the noise to car radio in the vehicle.

The noise to be reduced by the invention includes the above high-frequency energy noise from the driving axle to the outside, electrical signals flowing an electric cable, and electro-magnetic radiation from a housing of electronic equipment. Namely, in this specification, noise is electro-magnetic radiation radiated unintentionally from the electronic equipment of an electric vehicle or a hybrid vehicle.

Means for Solving the Problems

A metal graphite grounding brush according to the invention comprises a brush main body having silver as one of the main components of the brush main body, configured to be made in slide contact with an axle and to ground the axle, a mass composition in the brush main body between silver and carbonaceous components including graphite and a volatile component is silver more than 30 mass % and not more than 90 mass % and the carbonaceous components less than 70 mass % and not less than 10 mass %, and the content of the volatile component in the brush main body is not less than 2.0 mass % and not more than 15 mass %, where the total mass content of silver and the carbonaceous component is 100 mass %.

In this specification, the basic composition of the brush is indicated by the mass ratio between silver and carbonaceous components, and the organic volatile component is included in the carbonaceous components. The brush can include other metal components such as copper than silver and other inorganic materials such as a solid lubricant and an abrasive material. The concentrations of these third components are indicated as the total of silver and carbonaceous components being 100 mass % and are, for example, up to 5 mass % and, preferably up to 2 mass %.

Preferably, the resistivity of the brush main body is not more than 1000 micro-ohm-cm, and, in particular, not more than 100 micro-ohm-cm. Brushes having a resistivity in these ranges reduce efficiently electro-magnetic noise.

Preferably, the volatile component is an incompletely carbonized material of a binder resin in the brush main body and, particularly preferably, is the incompletely carbonized material of thermosetting binder resin. Under selected baking conditions of the brush, the binder resin decomposes incompletely without being fully carbonized and remains in the brush. This volatile component improves the brush strength, decreases the worn amount of the brush, and extends the service life of the brush.

Preferably, a lead wire of the brush is embedded into a pore portion in the brush with an embedding material that comprises a silver powder or a metal powder with a surface silver coating both without a binder resin. When the lead wire is embedded with the embedding material comprising a silver powder or a metal powder with a surface silver coating, the electric conductivity between the brush and the lead wire is improved in comparison to brushes in which the lead wire is embedded when the brush is press-molded. The embedding material that comprises a silver powder or a metal powder with a surface silver coating fits well the brush main body comprising silver and carbonaceous components. The embedding material without a binder resin further improves the electric conductivity between the lead wire and the brush.

The silver-carbonaceous brush according to the invention is configured to be made in slide contact with the peripheral surface of a driving axle of an electric motor propulsion vehicle and grounds the driving axle to a chassis of the vehicle. This reduces electro-magnetic noise in the vehicle and, in particular, the noise to a car radio in the vehicle. Electric motor propulsion vehicles are those running by secondary batteries or fuel cells or vehicles with secondary batteries running by both engines and electric motors. The driving axle is the shaft transmitting the motor power to the driving wheels of the vehicle.

A method according to the invention produces a metal graphite grounding brush that comprises a brush main body having silver as one of the main components of it and is configured to be made in slide contact with an axle and to ground the axle. The method according to the invention comprises:

a step for mixing and kneading a silver powder, a graphite powder, and a synthetic resin binder, in order to prepare a brush material; and a step for press-molding the brush material into a press-molded piece of the brush main body. The mass composition in the brush main body between silver and carbonaceous components comprising graphite and a volatile component derived from the synthetic resin binder is silver more than 30 mass % and not more than 90 mass % and the carbonaceous component less than 70 mass % and not less than 10 mass %, and the content of the volatile component in the brush main body is not less than 2.0 mass % and not more than 15 mass %, where the total mass content of silver and the carbonaceous component is 100 mass %. The volatile component decreases by baking, and the compositions in the produced brushes are more important than those in the raw materials.

The invention can be considered as a new shaft structure. The shaft structure comprises the shaft, a metal graphite grounding brush that has silver as one of the main components, is in slide contact with the peripheral surface of the shaft and grounds the shaft, and a spring keeping the grounding brush in contact with the peripheral surface of the shaft. The mass composition in the brush main body between silver and carbonaceous components including graphite and a volatile component is silver more than 30 mass % and not more than 90 mass % and the carbonaceous component less than 70 mass % and not less than 10 mass %. The content of the volatile component in the brush main body is not less than 2.0 mass % and not more than 15 mass %, the total mass content of silver and the carbonaceous component being 100 mass %. The spring pressure applied to the brush is not more than 1.6 $Kg/cm^2$ and, for example, not less than 0.1 $Kg/cm^2$ and not more than 1.6 $Kg/cm^2$, and, preferably, not less than 0.3 $Kg/cm^2$ and not more than 1.6 $Kg/cm^2$. The shaft is preferably the driving axle of a motor-driven vehicle.

The descriptions about the brush itself apply to the method for producing the brush and the shaft structure.

Advantageous Effects of the Invention

When the silver content in the brush is increased, the resistivity of the brush decreases. However, for eliminating noise from the axle, the total resistance that includes the resistance within the brush and the contact resistance between the brush and the axle is more important. In the present specification, the term "contact resistance" means the total resistance of the resistance within the brush and the contact resistance between the brush and the axle. According to the inventors' experiments, when the silver content exceeds 90% where the total mass of silver and carbonaceous components is defined as 100 mass %, the contact resistance at relatively low temperatures became unstable and sometimes abnormally high (FIGS. 5 and 6).

The next observation was that when the silver content was less than 30 mass %, the resistivity of the brush became very high and exceeded 1000 micro-ohm-cm. Based upon these observations, the silver content is made more than 30 mass % and not more than 90 mass %, the carbonaceous component content is made less than 70 mass % and not less than 10 mass %, where the total of silver and carbonaceous components is made 100 mass %. Preferably, the silver content is made not less than 50 mass % and not more than 75 mass %, and the carbonaceous component content is made not more than 50 mass % and not less than 25 mass %, where the total of silver and carbonaceous components is made 100 mass %. In these ranges, the contact resistance of the brush becomes small and the resistivity of the brush is not more than 100 micro-ohm-cm. As a result, the electro-magnetic noise from the axle can be made very small.

Brush raw materials include usually an organic component such as a binder resin. When the brush is baked at a relatively low temperature, the organic component such as the binder is thermally decomposed partially but not fully carbonized and remains a volatile incompletely carbonized material. The volatile component content in the brush affects the worn amount of the brush. When the volatile content is not less than 2.0 mass %, the strength of the brush increases, and the worn amount decreases, where the total of silver and carbonaceous components is made 100 mass %. When the volatile content is more than 15 mass %, chipping and swelling of the brush frequently occur due to the large volume of gas generated during the baking. Therefore, the volatile content is not less than 2.0 mass % and not more than 15 mass %, where the total of silver and carbonaceous components is made 100 mass %.

The above volatile component is preferably an incompletely carbonized material derived from a binder resin, is more preferably an incompletely carbonized material derived from a thermosetting resin binder, and is an incompletely carbonized phenol resin in the embodiment. Other thermosetting resins, such as furan resin, xylene resin, and thermosetting polyimide resin, can be used. In addition, thermoplastic resins, such as PPS (poly-phenylene-sulfide), PEEK (poly-ether-ether-ketone), PTFE (poly-tetra-fluoro-ethylene), POM (poly-oxi-methylene), and PI (polyimide), can be used.

The silver-carbonaceous grounding brush according to the invention is configured to be in slide contact with the peripheral surface of a driving axle of a motor-driven vehicle and to ground the axle to the chassis of the vehicle. Thus, the electro-magnetic noise to control equipment, electronic equipment, audio equipment in the vehicle is reduced, and, in particular, the noise to a car radio in a vehicle is reduced.

FEATURES FOR CARRYING OUT THE INVENTION

The best embodiment for carrying out the invention will be described. The invention is not limited to the embodiment, the scope of the invention is to be determined based upon the claims, and the invention can be modified with well-known features to the ordinary persons in the art.

Embodiment

The Structure and the Use of Grounding Brush

Figure 1:
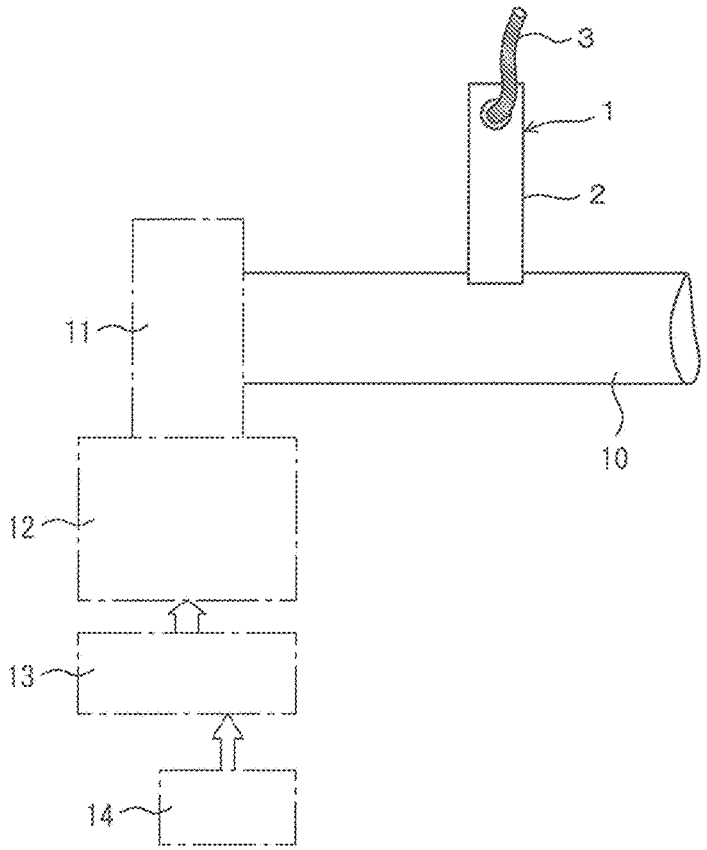
FIG. 1 is a view indicating a brush in use according to an embodiment.
Figure 2:
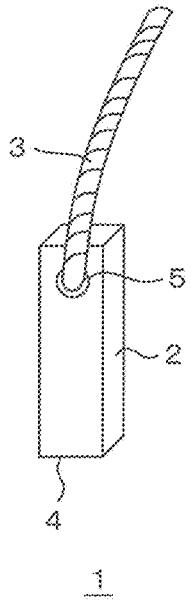
FIG. 2 is a perspective view of the brush according to the embodiment.

FIGS. 1 to 6 indicate grounding brushes according to the embodiments and their characteristics. FIG. 1 indicates a metal graphite grounding brush according to the embodiments in use, having silver as one of the main components of the brush main body. FIG. 2 indicates the structure of the grounding brush 1. Indicated by 2 is the brush main body and is, for example, provided with a lead wire 3. The brush main body 2 is, for example, a rectangular cuboid and has a sliding surface 4 to be in slide contact with an axle of a motor vehicle. Indicated by 5 is a pore portion of the brush main body 2 in which the lead wire 3 is embedded with an embedding material 6. The embedding material 6 is a silver powder or a metal powder with a surface silver coating (for example, a surface silver-plated copper powder) and does not include a binder resin. When one end of the lead wire 3 is embedded in the pore portion 5 with the embedding material 6, the resistance between the brush main body 2 and the lead wire 3 is reduced. Further, both the embedding material 6 and the brush main body 1 include silver, they fit well with each other. As a remark, the shape and the structure of the grounding brush 1 are arbitrary, and the lead wire 3 can be omitted.

Indicated by 10 is the driving axle of the motor vehicle, the sliding surface 4 of the brush main body 2 is in slide contact with the peripheral surface of the driving axle, and the driving axle 10 is grounded by the brush 1 through the lead wire 3 to the chassis of the motor vehicle. The motor vehicle is an electric vehicle or a hybrid vehicle driven with both electric cells and an engine. A control computer 14 controls an inverter 13 that controls the rotation speed of an electric motor 12. The rotation by motor 12 is reduced by a reducer 11 and transferred to the driving axle 10 for rotating the wheels not shown.

The Production of the Grounding Brush

A silver powder, a graphite powder, a binder resin, and other optional additives, if necessary, are mixed, and the mixture is press-molded into the brush main bodies 2. Then, for example, in a reducing atmosphere, the brush main bodies 2 are baked to the grounding brushes 1. For enhancing the strength and electric conductivity of the brush main bodies 2, dendritic silver powder is preferable as the silver powder. The graphite powder is, for example, a natural or an artificial graphite powder. The binder resin is, for example, a thermosetting resin. The brush main bodies 2 are baked at a temperature at which the resin is incompletely decomposed and remains as an incompletely carbonized component in the brush main bodies 2, for example, at a temperature not lower than 200 degree Celsius and not higher than 600 degree Celsius.

Figure 3:
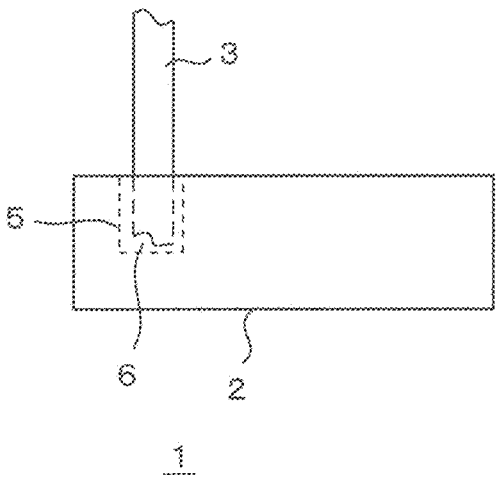
FIG. 3 is a side view of the brush according to the embodiment.

In the press-molding, the brush main body is press-molded into the shape indicated in FIGS. 2 and 3. However, a larger body may be press-molded, cut into smaller pieces, and then, leads 3 may be attached to the smaller pieces to produce the brushes 1 in FIGS. 2 and 3.

The brush main bodies 2 after the baking are processed into the shape with the pore portion 5 in FIGS. 2 and 3 by a milling machine. Then, one end of the lead wire 3 is embedded in the pore portion 5 with the embedding material 6 and is fixed in the pore portion 5; The embedding material 6 is compressed by applied pressure, for producing the completed brush. The embedding material may be a metal powder of copper, silver, or the like, or a surface coated metal powder. In particular, a silver powder or a metal powder with a surface coating of silver (for example, a copper powder surface coated by silver) is preferable. The embedding material 6 does not include a binder resin and preferably does not include other materials than the above metal powder.

The Shape of the Grounding Brush

The brush shape is indicated in FIG. 2, and the length L of the brush main body 2 is 16 mm, the depth D 5 mm, and the width W 5 mm. The lead wire 3 comprises twisted simple copper wires without any plating and has a diameter of 1.0 mm and a depth of the embedded portion of 3.0 mm.

In this specification, the mass of the binder resin is included in the mass of carbonaceous components, and the contents of silver and carbonaceous components are expressed in concentration where the total of silver and carbonaceous components is made 100 mass %. The binder resin content, at the raw material stage, is preferably not less than 2.5 mass % and not higher than 22 mass %. Generally, the silver content is more than 30 mass % and not higher than 90 mass %, and the carbonaceous component content is less than 70 mass % and not lower than 10 mass %. Preferably, the silver content is not lower than 50 mass % and not higher than 75 mass %, and the carbonaceous component content is not lower than 25 mass % and not higher than 50 mass %. The volatile component content is not lower than 2.0 mass % and not higher than 15 mass % and, preferably, is not lower than 2.5 mass % and not higher than 10 mass %. Additives other than carbonaceous components including the volatile component or silver may be a solid lubricant, such as molybdenum disulfide, tungsten disulfide, or an abrasive material, such as silica. The addition or non-addition of an additive is arbitrary, and the content of the additives, when added, is not higher than 2 mass % in the brush main body 2 and is preferably not higher than 1 mass %.

Test Examples

A flake graphite powder, a phenol resin binder, and acetone were mixed and kneaded, and then, pulverized such that they pass a 32 mesh sieve to obtain a binder-treated graphite powder. The binder-treated graphite powder was mixed with an electrolytic silver powder having a mean particle diameter of 15 micro-meter by a V-type mixer to obtain the material for the brush main body 2. The binder content is indicated by a net content without acetone solvent. The addition or non-addition and the species of other additives are arbitrary. The material compositions and characteristics of brushes according to the embodiment are indicated in Table 1, and the material compositions and characteristics of comparative brushes are indicated in Table 2. The material compositions are expressed in concentrations in which the total of silver and carbonaceous components is 100 mass %.

The materials for the brush main body were compression-molded and then baked at 300 degree Celsius to 700 degree Celsius in a reducing atmosphere to obtain the grounding brushes 1. For the produced grounding brushes 1, the silver concentrations and the carbonaceous component concentrations including the volatile component were measured as the following.

Quantitative Analysis of Silver and Carbon

The grounding brushes after baking were ground to weighed samples of each 5.0 g. The respective samples were dissolved in 15 mL of aqueous nitric acid comprising a mixture of nitric acid of relative gravity 1.38 and pure water, 1:1 in volume, and the silver content was completely dissolved in the solution by boiling the solution with a heater. Then, insoluble components were separated by a quantitative analysis filter paper (No. 5A) to prepare a nitric acid aqueous solution. Aqueous hydrochloric acid of 0.2 mol/L was gradually added till no further precipitation was observed to deposit silver chloride. The silver content was determined according to the weight of resultant silver chloride. Further, according to the dried weight of the insoluble components on the filter paper, the carbonaceous component content was determined. When the brush main body includes an additive other than silver or carbonaceous components, the total of the carbonaceous components and the additive is measured. When the brush main body includes an additive, the brush main body is baked at a temperature of at least 900 degree Celsius in air within an electric furnace, and the residual weight is measured to determine the additive content. When the brush main body includes other metal components than silver, for example, copper, the solution after filtering silver chloride is titrated with a PAN indicator by EDTA to measure the concentration of copper and so on. The samples of the grounding brushes were collected from the brush main bodies 2 from portions other than the pore portion 5.

The silver concentrations and the carbonaceous component concentrations comprising the graphite and the volatile component, after baking the brush main bodies 2, are indicated in Table 3 and Table 4. In the tables, the total of silver and carbonaceous components was made 100 mass %, and the additives, if any, were neglected.

Volatile Component Concentration

The volatile component concentrations in the brush main bodies were measured as follows. The brush main bodies were ground by the tip of a cutter to prepare 3 samples of 5 mg plus minus 0.2 mg. The samples were tested in a differential thermal analyzer (Rigaku company Ltd., TG-DTA, TG8120) and heated in a nitrogen atmosphere (nitrogen flow rate of 200 mL/min) from a room temperature to 902 degree Celsius at a temperature elevation rate of 20 degree Celsius. The measurement was started from a room temperature under air-conditioning that was the normal temperature defined by JIS Z 8703 (5 to 35 degree Celsius). After the heating, the weights before and after the heating were retrieved from the weight decreasing curve, and the weight loss ratio was retrieved. The measurements were made three times for three samples, and the mean weight loss ratio compensated with the total concentration of silver and carbonaceous components was made the volatile component concentration.

Resistivity of Brush

A direct current was applied between the sliding surface and the opposite surface, two terminals were made in contact with one side surface of the brush main body 2 (the right side surface in FIG. 2) with a spacing of 10 mm, and the voltage drop was measured by four-terminal method for four specimens. On the opposite surface, the voltage drop was similarly measured, and two data were resultant from one specimen. According to the average of the measured data for 2×4 specimens, the resistivity of the brush main body 2 was measured.

Contact Resistance

Figure 4:
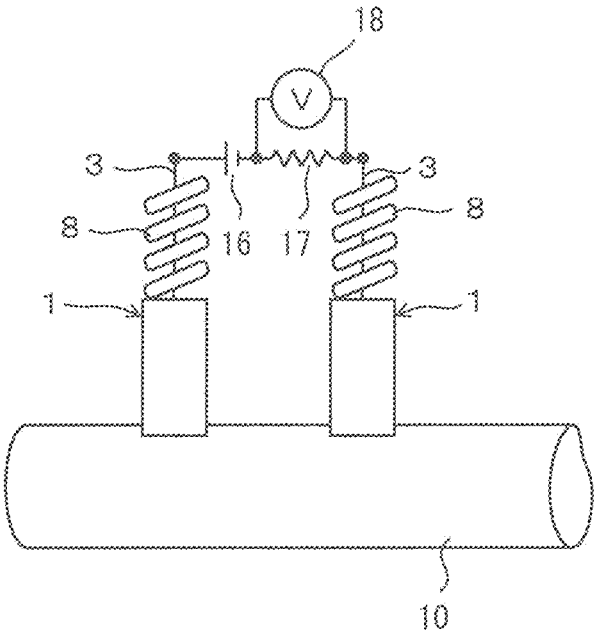
FIG. 4 is a view indicating the measurement method of the contact resistance according to the embodiment.
Figure 5:
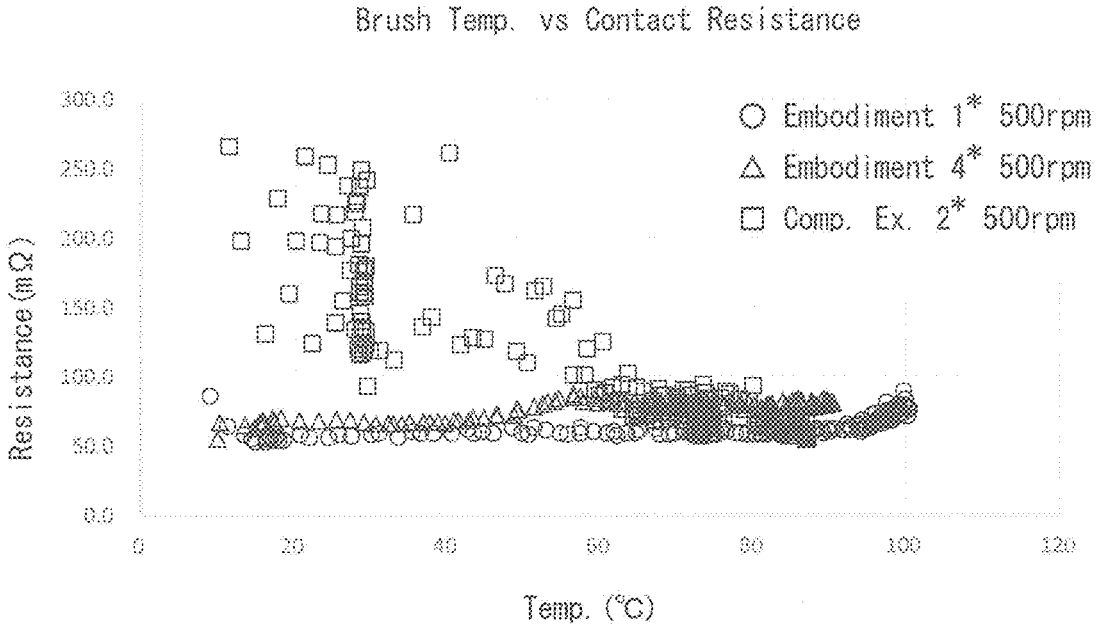
FIG. 5 is a characteristic view indicating the contact resistances of brushes according to both the embodiments and a comparative example, at a rotation speed of 500 rpm.
Figure 6:
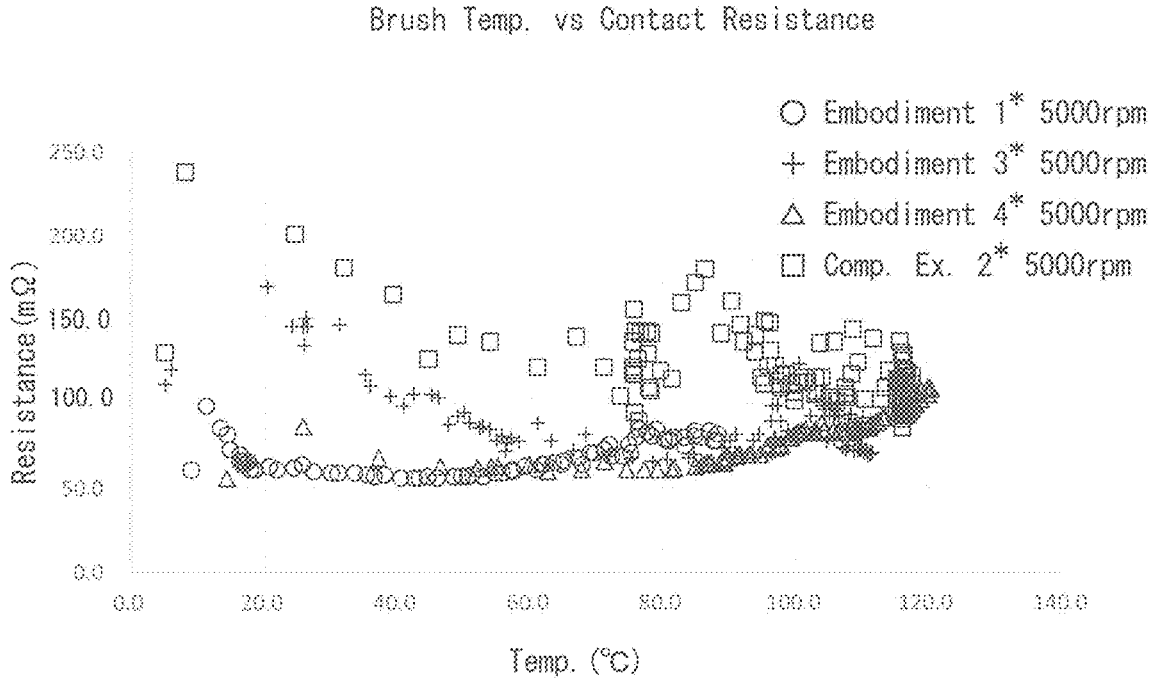
FIG. 6 is a characteristic view indicating the contact resistances of brushes according to both the embodiments and the comparative example, at a rotation speed of 5000 rpm.

The measurement of the contact resistance is indicated in FIG. 4. On a driving axle 10 of an electric vehicle (made of chrome-molybdenum steel, with a diameter of 10 mm and without a surface oil film), a pair of brushes 1, 1 were made in slide contact parallel. Each brush 1 was pressed towards the driving axle 10 by a spring 8 with a spring pressure of 1.56 $Kg/cm^2$. A direct current supply 16, a resistor 17, and a voltage meter 18 were connected as shown in FIG. 4, and the total resistance that comprises: the resistances within the brushes 1, 1; the contact resistance between the driving axle 10 and the brushes 1, 1; and the resistance within the driving axle 10 was measured based upon the voltage across the resistance 17. The resistance within the driving axle 10 was small, the resistances within the brushes 1, 1 were constant, and the variable factor was the contact resistance. With changing the atmospheric temperature and the rotation speed of the axle, the total resistance was measured. The variable factor in the measured resistances indicates the true contact resistance between the brushes 1, 1 and axle 10. The measurement results are shown in FIGS. 5 and 6. By the way, in the actual axle structure, for example, one brush 1 is made in contact with the peripheral surface of axle 10 by the spring 8.

Worn Amount

The brush 1 was made in slide contact with the axle 10, similarly to the measurement of the contact resistance. In this measurement, the atmospheric temperature was set at 80 degree Celsius, and the rotation speed of the axle 10 was set at 10,000 rpm. Before the measurement and after 200 hour slide contact, the length of the brush main body along the lengthwise direction of the brush was measured, and the difference in the length was made the wear amount.

Results

With reference to Tables 1 to 4, the results are analyzed. In the tables, the unit of the composition is mass %. As a remark, the binder concentrations in Tables 1 and 2 are different from the true volatile component concentrations in the brushes. For example, the embodiment 1 in Table 1 indicates that a volatile component of 5.2 mass % remained from the binder of 6.6 mass %. In this example, a part of binder corresponding to 1.4 mass % was lost due to the decomposition during the baking, the silver content of 70 mass % before the baking increased to 71 mass % after baking, the graphite concentration increased from 23.4% to 23.7%, and the volatile component concentration after the baking was 5.3%. The volatile component concentrations in the brushes and so on are indicated in Tables 3 and 4.

TABLE 1

(Embodiments)

| Composition* | Allowable Range | Emb. 1 | Emb. 2 | Emb. 3 | Emb. 4 | Emb. 5 | Emb. 6 |
|---|---|---|---|---|---|---|---|
| Ag | 30 to 90 | 70 | 32 | 85 | 55 | 74 | 70 |
| Carbon | 90 to 10 | 30 | 68 | 15 | 45 | 26 | 30 |
| Graphite | | 23.4 | 53.0 | 11.7 | 35.1 | 20.3 | 25.5 |
| Binder Resin | | 6.6 | 15.0 | 3.3 | 9.9 | 5.7 | 4.5 |
| Total | | 100 | 100 | 100 | 100 | 100 | 100 |
| Baking Temp. (degree Celsius) | | 400 | 400 | 400 | 400 | 300 | 500 |
| Volatile Component | 2.0 to 15.0 | 5.2 | 9.5 | 2.7 | 7.8 | 4.8 | 2.3 |
| Resistivity* | Up to 1000 | 15.5 | 780.2 | 5.8 | 65.5 | 65.6 | 13.8 |
| Worn Amount (mm) | Up to 0.8 | 0.62 | 0.45 | 0.75 | 0.63 | 0.63 | 0.80 |
| Shape after Baking* | | good | good | good | good | good | good |
| Variation in Contact Resistance (500 rpm) | | good | — | — | good | — | — |
| Variation in Contact Resistance (5000 rpm) | | good | — | Intermediate | good | — | — |

*Composition is in mass % unit.
*Resistivity is in micro-Ohm cm unit.
*Shape after Baking (Absence of Swelling or Chipping)

TABLE 2

(Comparative Examples)

| Composition* | Allowable Range | Com. 1 | Com. 2 | Com. 3 | Com. 4 |
|---|---|---|---|---|---|
| Ag | 30 to 90 | 25 | 95 | 70 | 32 |
| Carbon | 90 to 10 | 75 | 5 | 30 | 68 |
| Graphite | | 58.5 | 2.5 | 12.0 | 47.6 |
| Binder Resin | | 16.5 | 2.5 | 18.0 | 20.4 |
| Total | | 100 | 100 | 100 | 100 |
| Baking Temp. (degree Celsius) | | 400 | 400 | 700 | 300 |
| Volatile Component | 2.0 to 15.0 | 12.6 | 2.1 | 1.8 | 19.5 |
| Resistivity* | Up to 1000 | 2020.5 | 2.1 | 70.8 | 840.3 |
| Worn Amount (mm) | Up to 0.8 | 0.35 | 0.78 | 0.87 | 0.65 |
| Shape after Baking (Swelling or Chipping) | | good | good | good | Bad |
| Variation in Contact Resistance (500 rpm) | | — | Bad | — | — |
| Variation in Contact Resistance (5000 rpm) | | — | Bad | — | — |

*Composition is in mass % unit.
*Resistivity is in micro-Ohm cm unit.

TABLE 3

(Composition of Brush Main Body after Baking; Embodiments)

| Composition* | Emb. 1 | Emb. 2 | Emb. 3 | Emb. 4 | Emb. 5 | Emb. 6 |
|---|---|---|---|---|---|---|
| Ag | 71 | 34 | 85.5 | 56.2 | 74.3 | 71.6 |
| Carbon | 29 | 66 | 14.5 | 43.8 | 25.7 | 28.4 |
| Graphite | 23.7 | 56 | 11.8 | 35.8 | 20.3 | 26.1 |
| Binder Resin | 5.3 | 10 | 2.7 | 8.0 | 5.4 | 2.3 |

*Composition is in mass % unit.

TABLE 4

(Composition of Brush Main Body after Baking; Comparative Examples)

| Composition* | Com. 1 | Com. 2 | Com. 3 | Com. 4 |
|---|---|---|---|---|
| Ag | 26 | 95.4 | 83.5 | 32.3 |
| Carbon | 74 | 4.6 | 16.5 | 67.7 |

TABLE 4-continued (Composition of Brush Main Body after Baking; Comparative Examples)

| Composition* | Com. 1 | Com. 2 | Com. 3 | Com. 4 |
|---|---|---|---|---|
| Graphite | 61 | 2.5 | 14.1 | 48.0 |
| Binder Resin | 13 | 2.1 | 2.1 | 19.7 |

*Composition is in mass % unit.

Results

When reducing the volatile component concentration, the worn amount increased, and, in the comparative example 3 having 1.8 mass % of volatile component, the worn amount exceeded an allowable range. On the contrary, in the embodiment 6 and the comparative example 2, both having at least 2 mass % of volatile component, the worn amounts were within the allowable range. From these data, the lower limit of the volatile component is set to 2 mass %. When further increasing the volatile component concentration, swelling and chipping during the baking were observed. A brush with 19.5 mass % of volatile component (the comparative example 4) was out of an allowable range, and a brush with 12.6 mass % of volatile component (the comparative example 1) was within the allowable range. Therefore, the upper limit of the volatile component is set to 15 mass %. The volatile component concentration is preferably at least 2.0 mass % and at most 10 mass %.

The resistivity of the brush main body 2 decreased with increasing the silver concentration. In the embodiment 2 and the comparative example 4 both having 32 mass % of silver, the resistivity was within an allowable range, and, in the comparative example 1 having 25 mass % of silver, the resistivity was out of the allowable range. Therefore, the silver concentration above 30 mass % is needed. When the silver concentration is made 50 mass % or more, the resistivity of the brush main body 2 became enough low (the embodiments 1, 3 to 6, and the comparative example 3), and therefore, the silver concentration is preferably at least 50 mass %.

The contact resistance of the brush is indicated in FIG. 5 (at 500 rpm) and in FIG. 6 (at 5000 rpm). In both FIGS. 5 and 6, in the comparative example 2 (silver concentration of 95 mass %), the contact resistance fluctuated remarkably and the average value of the contact resistance was high. In particular, when the atmospheric temperature was relatively low and when the rotation speed was low (FIG. 5), the comparative example 2 showed remarkable variations in the contact resistance. Further, even when the rotation speed was high (FIG. 6), the comparative example 2 showed large contact resistance fluctuations and high average contact resistance. The embodiment 1 having the silver concentration of 77 mass % and the embodiment 4 having the silver concentration of 55 mass % had low and stable contact resistances with small fluctuations in the contact resistance. In addition, the embodiment 3 (FIG. 6) having a silver concentration of 85 mass % indicated intermediate results between the comparative example 2 and the embodiments 1 and 4.

When the spring pressure making the brush 1 in contact with the axle 10 is too large, the worn amount increased, and, when it was too small, the contact became unstable. The preferable spring pressure is not more than 1.6 $Kg/cm^2$ and, for example, not less than 0.1 $Kg/cm^2$ and not more than 1.6 $Kg/cm^2$. More preferably, the spring pressure is not less than 0.3 $Kg/cm^2$ and not more than 1.6 $Kg/cm^2$.

These data fit well the magnitude of noise from a car radio in an electric vehicle, evaluated by a functional test. Namely, the comparative example 1 mixed unpleasant noise into the sound of the car radio when accelerated from a low speed running. However, the noise from the car radio was small in the embodiments 1 to 6, and, in particular, the noise from the car radio was specially small in the embodiments 1, 4, 5, and 6. Since the embodiments 1 and 4 afforded the best results and the embodiment 3 afforded the next, the silver concentration in the brush main body 2 is preferably at least 50 mass % and at most 75 mass %.

According to the grounding brushes of the embodiments, the worn amount is small, no chipping nor swelling occurs in the brush main body, and the contact resistance between the driving axle is small.

Ag—Cu Mixture System

A small amount of another metal, such as copper, than silver can be included. In this case, in the mass ratio between silver and carbonaceous components including the volatile component, silver is above 30% and at most 90%, and carbonaceous components is less than 70% and at least 10%. Other than silver and the carbonaceous components, copper or a similar metal, or additives, such as solid lubricant, can be included. The concentration of copper or other metals in the brush main body is, for example, not more than 20 mass %, preferably not more than 16 mass %, more preferably not more than 12 mass %, particularly preferably, not more than 6 mass %, and most preferably not more than 5 mass %. Other metals than silver do not improve the brush characteristics but are generally cheaper than silver.

With usage of 0.5 mass % of molybdenum disulfide and with replacing silver powder partly by electrolytic copper powder of 5, 10, or 20 mass %, grounding brushes of embodiments 7 to 9 were produced, similarly to the embodiment 1. Other production conditions were made identical to the embodiment 1. The raw material composition of the brush main body and the volatile component concentration after the baking at 400 degree Celsius are indicated in Table 5.

TABLE 5

| | | (Embodiments) | | | |
|---|---|---|---|---|---|
| Composition* | Allowable Range | Emb. 1 | Emb. 7 | Emb. 8 | Emb. 9 |
| Ag | 30 to 90 | 70 | 65 | 60 | 50 |
| Cu | Up to 20 | — | 5 | 10 | 20 |
| $MoS_2$ | Up to 5 | — | 0.5 | 0.5 | 0.5 |
| Carbon | 90 to 10 | 30 | 29.5 | 29.5 | 29.5 |
| Graphite | | 23.4 | 22.9 | 22.9 | 22.9 |
| Binder Resin | | 6.6 | 6.6 | 6.6 | 6.6 |
| Total | | 100 | 100 | 100 | 100 |
| Baking Temp. (degree Celsius) | | 400 | 400 | 400 | 400 |
| Volatile Component | 2.0 to 15.0 | 5.3 | 5.2 | 4.8 | 4.8 |

*Composition is in mass % unit.

Figure 7:
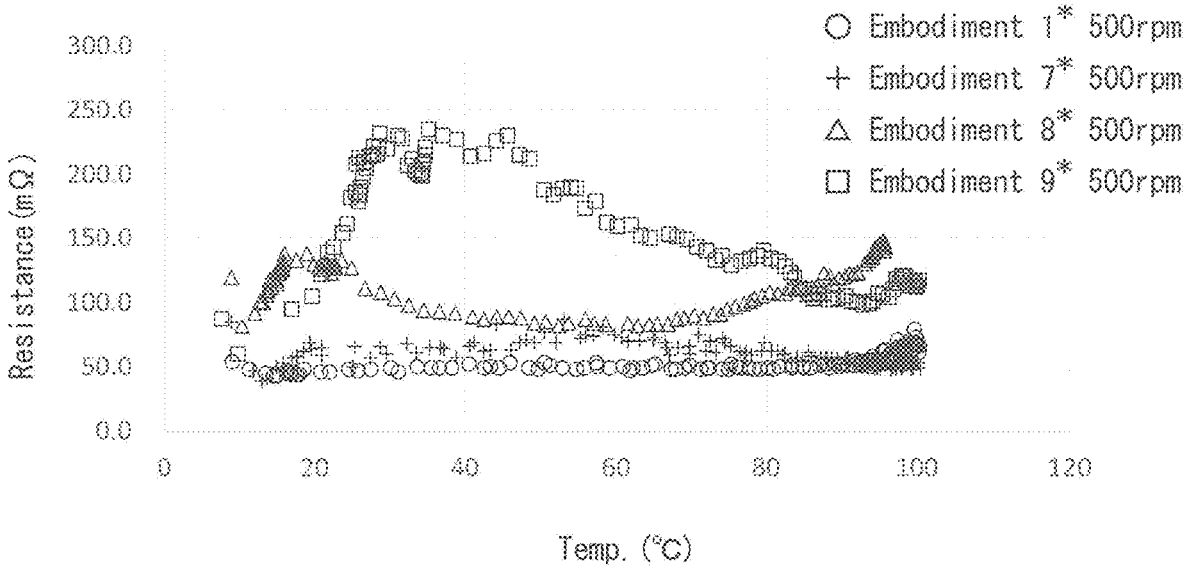
FIG. 7 is a characteristic view indicating the contact resistances of copper-containing brushes according to embodiments at a rotation speed of 500 rpm.

FIG. 7 indicates the contact resistance between the brushes and the axle at the same measuring conditions as FIG. 5. When the brush main body included copper by 10 mass % or more, the performance became lower. When it included copper by 20 mass %, the brushes could be used in restricted environments. When including copper by 10 mass %, the brushes could be used at all environmental temperatures but with reduced performance, and when including copper by 5 mass %, the brushes could be used at all environmental temperatures.

DESCRIPTION OF SYMBOLS

1 grounding brush
2 brush main body
3 lead
4 sliding surface
5 pore portion
6 embedding material
8 spring coil
10 driving axle
11 reducer
12 electric motor
13 inverter
14 control computer
16 direct power supply
17 resistor
18 voltage meter

The invention claimed is:

1. A metal graphite grounding brush comprising a brush main body having silver as one of main components of the brush main body and being configured to be made in slide contact with an axle for grounding said axle, wherein a mass composition in the brush main body between silver and carbonaceous components including graphite and a volatile component is silver more than 30 mass % and not more than 90 mass % and the carbonaceous component less than 70 mass % and not less than 10 mass %, and wherein a content of the volatile component in the brush main body is not less than 2.0 mass % and not more than 15 mass %, total mass content of silver and the carbonaceous component being 100 mass %.

2. The metal graphite grounding brush according to claim 1, wherein a resistivity of said brush main body is not more than 1000 micro-ohm-cm.

3. The metal graphite grounding brush according to claim 1, wherein said volatile component is an incompletely carbonized material of a binder resin in the brush main body.

4. The metal graphite grounding brush according to claim 3, wherein said volatile component is an incompletely carbonized material of thermosetting binder resin.

5. The metal graphite grounding brush according to claim 1, being configured to be made in slide contact with a peripheral surface of a driving axle of an electric motor propulsion vehicle, to ground said driving axle to a chassis of said vehicle, and to reduce electro-magnetic noise in said vehicle.

6. The metal graphite grounding brush according to claim 5, being configured to reduce noise contained in sound from a car radio in the vehicle.

7. A method for producing a metal graphite grounding brush comprising a brush main body having silver as one of main components of the brush main body and being configured to be made in slide contact with an axle for grounding said axle, said method comprising:

a step for mixing and kneading a silver powder, a graphite powder, and a synthetic resin binder, in order to prepare a brush material; and a step for press-molding said brush material into a press-molded piece of the brush main body, such that a mass composition in the brush main body between silver and carbonaceous component comprising graphite and a volatile component derived from the synthetic resin binder is silver more than 30 mass % and not more than 90 mass % and the carbonaceous component less than 70 mass % and not less than 10 mass %, and such that a content of the volatile component in the brush main body is not less than 2.0 mass % and not more than 15 mass %, total mass content of silver and the carbonaceous component being 100 mass %.

8. The method for producing a metal graphite grounding brush according to claim 7, wherein said press-molded piece is baked at a temperature not lower than 200 degree Celsius and not higher than 600 degree Celsius, after the press-molding step.

* * * * *